US011730994B2

(12) United States Patent
Hernandez

(10) Patent No.: US 11,730,994 B2
(45) Date of Patent: Aug. 22, 2023

(54) HANDGRIP FOR SKIPPING ROPES

(71) Applicant: VELITES FITNESS, S.L., Navarra (ES)

(72) Inventor: Matias Hernandez, Navarra (ES)

(73) Assignee: VELITES FITNESS, S.L., Navarra (ES)

( * ) Notice: Subject to any disclaimer, the term of this patent is extended or adjusted under 35 U.S.C. 154(b) by 39 days.

(21) Appl. No.: 17/465,283

(22) Filed: Sep. 2, 2021

(65) Prior Publication Data

US 2022/0072356 A1 Mar. 10, 2022

(51) Int. Cl.

| | |
|---|---|
| ***A63B 5/20*** | (2006.01) |
| ***A63B 21/00*** | (2006.01) |
| ***A63B 21/06*** | (2006.01) |

(52) U.S. Cl.

CPC ..... *A63B 5/20* (2013.01); *A63B 21/00058* (2013.01); *A63B 21/06* (2013.01); *A63B 21/4035* (2015.10); *A63B 21/00061* (2013.01); *A63B 21/00065* (2013.01)

(58) Field of Classification Search

CPC ..... A63B 5/20; A63B 5/205; A63B 21/4035; A63B 21/00058; A63B 21/00061; A63B 21/00065; A63B 21/06; A63B 21/4049; A63B 22/0002

See application file for complete search history.

(56) References Cited

U.S. PATENT DOCUMENTS

| | | | | |
|---|---|---|---|---|
| 4,637,606 | A * | 1/1987 | Hunn | A63B 5/20 482/82 |
| 6,544,148 | B1 * | 4/2003 | Loew | A63B 5/20 482/82 |
| 6,752,746 | B1 * | 6/2004 | Winkler | A63B 5/20 482/126 |
| 10,478,655 | B2 * | 11/2019 | Hunt | A63B 5/20 |
| 10,556,147 | B2 * | 2/2020 | Zhang | A63B 5/20 |
| 10,709,920 | B2 * | 7/2020 | Hopkins | A63B 21/4049 |
| 10,933,270 | B2 * | 3/2021 | Gagne | A63B 5/20 |
| 11,229,814 | B1 * | 1/2022 | Week | A63B 23/03508 |
| 11,524,200 | B2 * | 12/2022 | Pettersson | A63B 23/03525 |

* cited by examiner

*Primary Examiner* — Megan Anderson
(74) *Attorney, Agent, or Firm* — Lucas & Mercanti, LLP

(57) ABSTRACT

A handgrip for skipping ropes having a hollow handle, for gripping the handgrip and configured for housing at least one internal ballast; and a connection element for connecting the handle to a rope; an external ballast able to be fixed to the handle, surrounding and configured for gripping the handgrip.

5 Claims, 4 Drawing Sheets

1

HANDGRIP FOR SKIPPING ROPES

CROSS-REFERENCE TO RELATED APPLICATION

This application claims the benefit of priority of Spanish Patent Application No. U202031965, filed on Sep. 9, 2020, which is incorporated herein by reference.

TECHNICAL FIELD

The present invention relates to handgrips for skipping ropes, preferably for skipping ropes with customisable weight, intended for physical exercise.

STATE OF THE ART

Skipping rope exercises are often used as a sports warm-up prior to other exercises, and they are an ideal workout for sports that require stamina, coordination and rhythm. These exercises strengthen and renew the texture of the muscles, and they are considered suitable for the heart and the lungs.

When carrying out physical activity with skipping rope, it is common for the user to need to modify the features of his skipping rope depending on the objective to be achieved with the exercise. The main factor to modify is the weight of the skipping rope, which depends on the wire and the handgrip.

To prevent the user from requiring a large number of complete skipping ropes each with the weight of interest, there are skipping ropes that enable the wire to be replaced by a heavier or lighter one and also enable ballasts to be incorporated into the handgrip by adapting its weight to the exercise to be performed.

When carrying out physical activity, it is essential that the modifications in the apparatuses can be made in an agile and simple manner to prevent the rhythm of the exercise from being interrupted. Furthermore, it is important that the incorporated ballasts do not create points of inertia that can cause problems for the athlete, which happens for example if the ballasts are arranged only at one end of the handle.

It is therefore necessary to develop a system that enables a quick replacement of the different ropes and/or ballasts of the handgrip, without the changes causing discomfort to the athlete during physical exercise.

OBJECT OF THE INVENTION

For all the above reasons, the object of the present invention is a handgrip for skipping ropes, comprising:

- a hollow handle, for gripping the handgrip and configured for housing at least one internal ballast; and
- a connection means for connecting the handle to a rope;

wherein an external ballast is able to be fixed to the handle surrounding the handle and configured for gripping the handgrip.

This external ballast would preferably have a shape similar to that of the handle, but with a larger diameter, enabling it to be used for gripping the handgrip. This not only enables the weight of the handgrip to be increased, but also the gripping surface to be increased, which is beneficial for exercises of greater weight and intensity, wherein the tight grip is uncomfortable.

Preferably one of the internal ballasts is a plug ballast able to be fixed to the handle configured for retaining the external ballast to the handle. This enables the external ballast to be immobilised around the handle such that it does not vibrate or escape from the handgrip, obtaining a better grip and balance of the weight of the handgrip to avoid creating points of inertia that inconvenience the athlete.

Preferably the plug ballast is configured for connecting with an additional internal ballast, thus increasing the weight configuration options of the handgrip.

In this way, the plug ballast retains the additional internal ballast, fixing the same preferably by abutting by contact or by means of threading, to prevent it from moving and causing the already mentioned points of inertia.

Preferably the connection means comprises:

- a coupling element able to be fixed to the rope;
- a receiving element able to be fixed to the handle and configured for receiving the coupling element,
- a retaining bushing to retain the coupling element in the receiving element in a closed position, and
- a spring that acts axially against the retaining bushing to keep the bushing in the coupling closed position,
- the receiving element being provided with a protrusion configured for retaining the bushing by abutting against an edge of the bushing in a coupling open position.

With all this, the connection means is made to retain the closure in the open position during the replacement of the rope, which, in the middle of a physical activity, with the user being sweaty and tired, is a great advantage, since it is not necessary to act against the force of the spring with the hand, but said bushing is temporarily retained to facilitate the insertion of the rope coupling into the receiving element, enabling an easy replacement of the rope as required.

Furthermore, the use of a retaining bushing improves the strength during the closed position of the connection means, increasing safety during the performance of physical exercise.

Preferably the bushing is provided with a groove configured for guiding the bushing between the closed position and the open position in correspondence with the protrusion, thereby further facilitating the process of replacing the ropes to the handgrip.

DETAILED DESCRIPTION OF THE INVENTION

Figure 1:
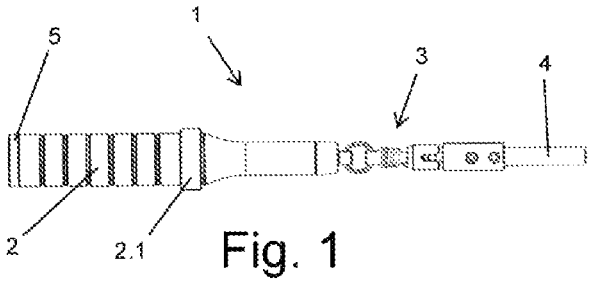
FIG. 1 shows a plan view of an exemplary embodiment of a handgrip for skipping ropes, without internal or external ballast.

FIG. 1 shows a preferred exemplary embodiment of the present invention, specifically a handgrip (1) for skipping ropes, which is made up of a hollow handle (2), a connection means (3) for connecting between the handgrip (1) and a rope (4). In this example, the hollow of the handle (2) is covered by a plug (5), preventing the inside of the hollow of the handle (2) from getting dirty when the handle (2) is empty. As such, in this case only the weight of the handle (2) without any additional ballast would act.

Figure 2:
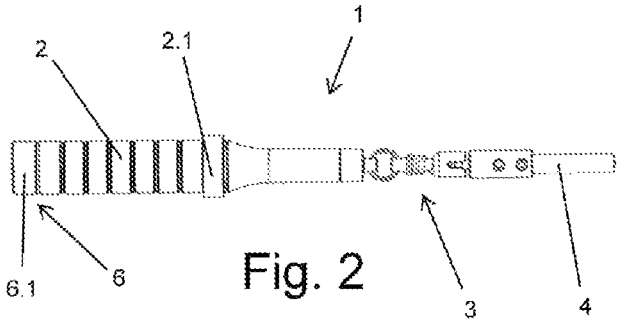
FIG. 2 shows a plan view of an exemplary embodiment of a handgrip for skipping ropes with an incorporated plug ballast.

The plug (5) can be replaced by an internal ballast (6), in this exemplary embodiment by a plug ballast (6.1) by threading it in the hollow of the handle (2) as shown in FIG. 2. This makes the incorporation of additional weight into the handgrip (1) quick and intuitive.

Figure 3:
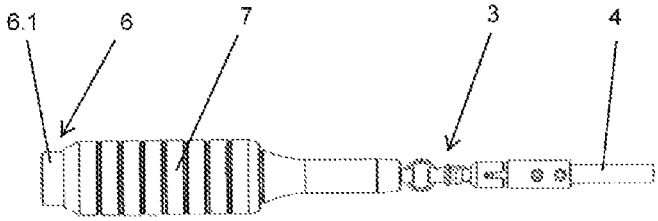
FIG. 3 shows a plan view of an exemplary embodiment of a handgrip for skipping ropes with an incorporated plug ballast and an incorporated external ballast.
Figure 4:
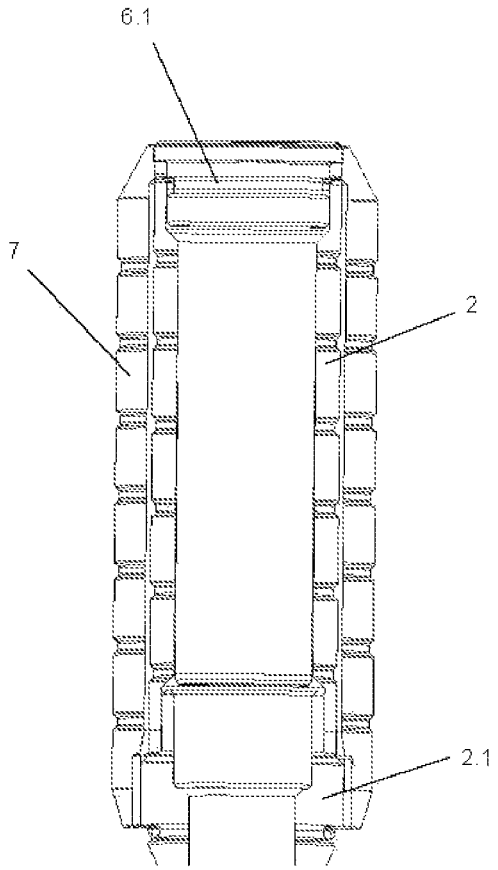
FIG. 4 shows a cross-sectional view of the joint between the handle, the external ballast and the plug ballast of an exemplary embodiment.

When it is necessary that the skipping rope has greater weight for the exercise to be performed by the user, the handgrip is configured for incorporating an external ballast (7) around the handle (2), such that the external ballast (7) entirely surrounds the handle (2), as shown in FIGS. 3 and 4, which also prevents the concentration of the weight of the handgrip (1) from varying towards one of the ends thereof. This external ballast (7) has a cylindrical shape with a diameter greater than the handle (2), enabling the external ballast (7) to increase both the weight and the gripping surface of the handgrip (1), which is beneficial for exercises of greater weight and intensity, wherein the tight grip is uncomfortable.

As can be seen in FIGS. 1 and 2, the handle (2) comprises a larger diameter area at the end closest to the connection means (3), which we will call stop (2.1). Said stop (2.1) prevents the external ballast (7) from moving in the direction of the connection means (3) beyond a certain point when being incorporated into the handgrip (1).

Preferably, once the external ballast (7) has been inserted around the handle (2), the plug ballast (6.1) would be threaded on the handle (2), preventing the external ballast (7) from moving in the opposite direction to the connection means (3) pushing the external ballast (7) against the stop (2.1), as can be seen in FIG. 4, securing the external ballast (7) to the handgrip (1) during the performance of physical exercise.

Figure 5:
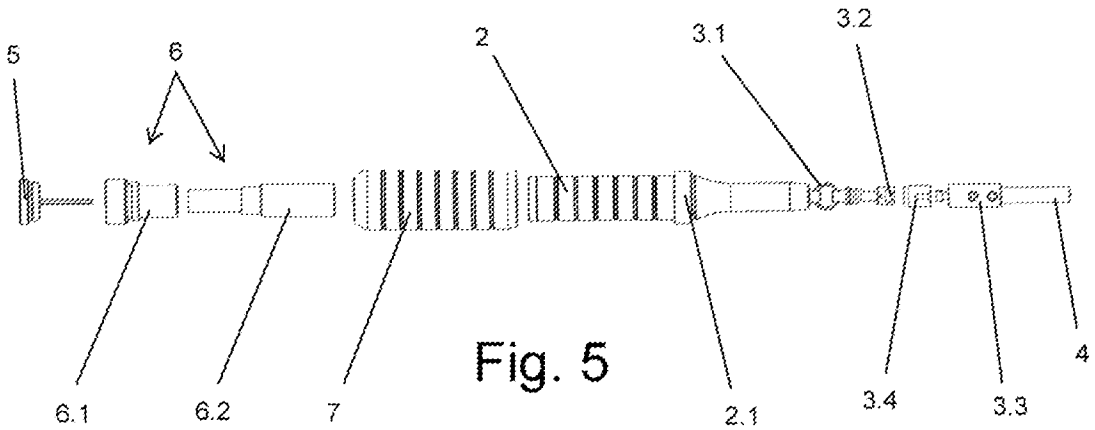
FIG. 5 shows an exploded view of an exemplary embodiment.

FIG. 5 shows an exploded view of the different elements of the preferred exemplary embodiment, among which an additional internal ballast (6.2) can be observed, which enables a greater customisation of the weight of the handgrip (1). This additional internal ballast (6.2) is elongated so that it can be inserted inside the handle (2) and to prevent the concentration of the weight from varying towards one of the ends of the handgrip (1).

Said additional internal ballast (6.2) is retained inside the handle (2) by the plug ballast (6.1) that prevents the movement thereof either by contact or by threading the additional internal ballast (6.2) in the plug ballast (6.1).

In a non-limiting preferred exemplary embodiment, the plug ballast (6.1) has a weight of 50 mg, the additional internal ballast (6.2) has a weight of 100 mg and the external ballast (7) has a weight of 200 mg. Thus obtaining five different weight options for the handgrip (1):

Without any additional weight

Additional weight of 50 mg: plug ballast (6.1)

Additional weight of 150 mg: plug ballast (6.1)+additional internal ballast (6.2)

Additional weight of 250 mg: plug ballast (6.1)+external ballast (7)

Additional weight of 350 mg: plug ballast (6.1)+additional internal ballast (6.2)+external ballast (7)

These weights can be combined with the use of ropes (6) of different weights.

Thus, preferably the connection means (3) comprises, as can be seen in FIG. 5, a ring (3.1) that connects the connection means (3) with the rest of the handgrip (1). The ring (3.1) enables a greater degree of movement of the rope (6) during the performance of physical exercise, improving the comfort of the user.

The ring (3.1) is connected to a tubular element ending in a receiving element (3.2) configured for receiving the coupling element (3.3) fixed to the rope (4), which enables the connection between the handgrip (1) and the rope (4) facilitating the exchange of different types of ropes.

Figure 6:
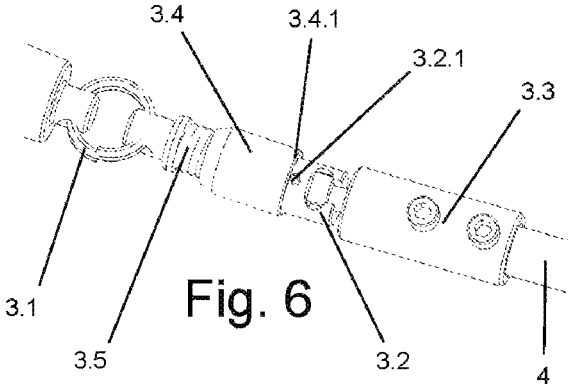
FIG. 6 shows a perspective view of an exemplary embodiment of the connection means in the closed position.

Additionally, the connection means (3) comprises a retaining bushing (3.4) configured for retaining the coupling element (3.3) in the receiving element (3.2) in a closed position, as can be seen in FIG. 6. For this, the retaining bushing (3.4) has a cylindrical shape with a hollow inside that enables the retaining bushing (3.4) to surround the receiving element (3.2) and thus retain the coupling element (3.3) preventing it from coming out of the coupling position thereof.

The retaining bushing (3.4) provides more resistance and safety to the coupling between the coupling element (3.3) and the receiving element (3.2), preventing them from coming out of the coupling position thereof while enabling easy replacement.

In addition, the connection means comprises a spring (3.5) that acts axially against the retaining bushing (3.4) in the direction of the receiving element (3.2), thus making it impossible, for example during the performance of physical exercise, for the coupling element (3.3) to be uncoupled from the receiving element (3.2).

Figure 7:
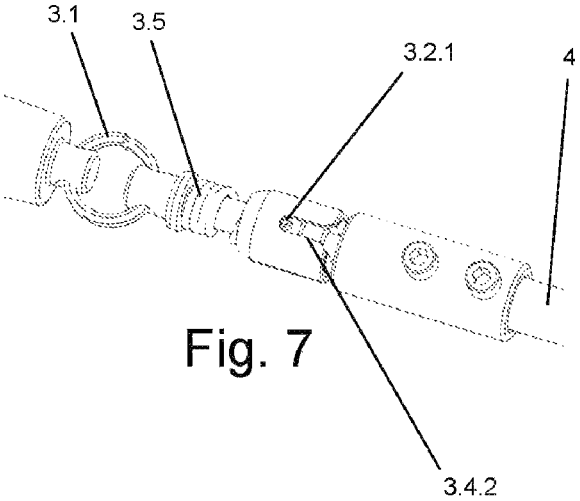
FIG. 7 shows a perspective view of an exemplary embodiment of the connection means in the open position.

The receiving element (3.2) is provided with a protrusion (3.2.1) configured for retaining the retaining bushing (3.4) in a coupling open position by abutting against an edge (3.4.1) of the retaining bushing (3.4), such as can be seen in FIG. 7.

The retaining bushing (3.4) is provided with a groove (3.4.2) configured for guiding the retaining bushing (3.4) between the closed position and the open position.

Therefore, when the user proceeds to change the rope (4) connected to the handgrip (1) with the connection means in the closed position, as can be seen in FIG. 6, the retaining bushing (3.4) is pushed in the opposite direction to the receiving element (3.2) against the force of the spring (3.5). Once the protrusion (3.2.1) passes the groove (3.4.2), the retaining bushing (3.4) is rotated in any direction, such that the spring (3.5) pushes the edge (3.4.1) of the retaining bushing (3.4) against the protrusion (3.2.1), retaining the connection means (3) in the open position, as can be seen in FIG. 7.

By arranging the retaining bushing (3.4) retained in the open position, the uncoupling of the coupling element (3.3) from the rope (4) of the receiving element (3.2) is facilitated, and subsequently a coupling element (3.3) of another rope (4) can be coupled in the receiving element (3.2) without the need to be acting against the spring (3.5) or to use solutions of another type that do not ensure the final coupling. Finally, the retaining bushing (3.4) is rotated until the groove (3.4.2) and the protrusion (3.2.1) are aligned, such that the spring (3.5) pushes the retaining bushing (3.4) to the closed position, surrounding the coupling element (3.3) and the receiving element (3.2), ensuring the coupling of the new rope (4).

The invention claimed is:

1. A handgrip for skipping ropes, comprising:

a hollow handle for gripping a handgrip and configured to house at least one internal ballast;

a connection means for connecting the hollow handle to a rope;

an external ballast fixed to the hollow handle, surrounding the hollow handle and configured to grip the handgrip.

2. The handgrip for skipping ropes according to claim 1, wherein the at least one internal ballast is a plug ballast fixed to the hollow handle and configured to retain the external ballast to the hollow handle.

3. The handgrip for skipping ropes according to claim 2, wherein the plug ballast is configured to connect with the at least one internal ballast.

4. The handgrip for skipping ropes according to claim 1, wherein the connection means comprises:

a coupling element fixed to the rope;

a receiving element fixed to the hollow handle and configured to receive the coupling element;

a retaining bushing to retain the coupling element in the receiving element in a closed position, and a spring that acts axially against the retaining bushing to keep the retaining bushing in the coupling closed position, the receiving element provided with a protrusion configured to retain the retaining bushing by abutting against an edge of the retaining bushing in a coupling open position.

5. The handgrip for skipping ropes according to claim 4, wherein the retaining bushing is provided with a groove configured to guide the retaining bushing between the closed position and the open position in correspondence with the protrusion.

* * * * *